US010731520B2

(12) United States Patent
Olovsson et al.

(10) Patent No.: US 10,731,520 B2
(45) Date of Patent: Aug. 4, 2020

(54) VARIABLE CAM TIMING PHASER UTILIZING SERIES-COUPLED CHECK VALVES

(71) Applicant: Scania CV AB, Södertälje (SE)

(72) Inventors: Daniel Olovsson, Södertälje (SE); Mikael Eriksson, Torslanda (SE)

(73) Assignee: Scania CV AB, Södertälje (SE)

( * ) Notice: Subject to any disclaimer, the term of this patent is extended or adjusted under 35 U.S.C. 154(b) by 0 days.

(21) Appl. No.: 16/306,860

(22) PCT Filed: May 10, 2017

(86) PCT No.: PCT/SE2017/050469
§ 371 (c)(1),
(2) Date: Dec. 3, 2018

(87) PCT Pub. No.: WO2017/213570
PCT Pub. Date: Dec. 14, 2017

(65) Prior Publication Data

US 2019/0145290 A1 May 16, 2019

(30) Foreign Application Priority Data

Jun. 8, 2016 (SE) ..... 1650798

(51) Int. Cl.
*F01L 1/344* (2006.01)

(52) U.S. Cl.
CPC ..... *F01L 1/34409* (2013.01); *F01L 1/3442* (2013.01); *F01L 2001/34433* (2013.01)

(58) Field of Classification Search
CPC ..... F01L 1/34409; F01L 1/3442; F01L 1/344; F01L 2001/34433; F01L 2001/34426; F01L 2001/3443
USPC ..... 123/90.17, 90.15, 90.16
See application file for complete search history.

(56) References Cited

U.S. PATENT DOCUMENTS

| | | | | |
|---|---|---|---|---|
| 5,056,477 | A | 10/1991 | Linder et al. | |
| 5,649,506 | A | 7/1997 | Melchior | |
| 7,000,580 | B1 | 2/2006 | Smith et al. | |
| 7,311,069 | B2 | 12/2007 | Kobayashi et al. | |
| 8,127,725 | B2 | 3/2012 | Crowe et al. | |
| 8,584,636 | B2 | 11/2013 | David et al. | |
| 2002/0088413 | A1 | 7/2002 | Smith et al. | |
| 2004/0182344 | A1 | 9/2004 | Simpson et al. | |
| 2005/0028771 | A1* | 2/2005 | Jiang | F01L 1/3442 123/90.17 |
| 2005/0103293 | A1 | 5/2005 | Lancefield | |
| 2007/0017463 | A1 | 1/2007 | Mott et al. | |
| 2007/0028874 | A1 | 2/2007 | Simpson | |
| 2007/0039581 | A1 | 2/2007 | Berndorfer | |
| 2008/0135004 | A1 | 6/2008 | Simpson et al. | |
| 2009/0071140 | A1 | 3/2009 | Knecht et al. | |
| 2009/0178635 | A1 | 7/2009 | Takenaka | |
| 2013/0139916 | A1 | 6/2013 | Miyachi | |
| 2013/0199478 | A1* | 8/2013 | Tanaka | F01L 1/3442 123/90.17 |
| 2013/0206088 | A1* | 8/2013 | Wigsten | F01L 1/3442 123/90.15 |
| 2013/0220253 | A1 | 8/2013 | Pluta et al. | |
| 2013/0291835 | A1 | 11/2013 | Imamura et al. | |
| 2014/0102392 | A1 | 4/2014 | Busse | |
| 2014/0251247 | A1 | 9/2014 | Tewes et al. | |
| 2014/0261266 | A1* | 9/2014 | Wigsten | F01M 9/10 123/90.17 |
| 2016/0024980 | A1 | 1/2016 | Sakata et al. | |
| 2016/0053640 | A1 | 2/2016 | Schafer et al. | |
| 2016/0108774 | A1* | 4/2016 | Pietrzyk | F01L 1/3442 123/90.1 |

FOREIGN PATENT DOCUMENTS

| | | | |
|---|---|---|---|
| CN | 101171404 | A | 4/2008 |
| CN | 102003292 | A | 4/2011 |
| CN | 102482959 | A | 5/2012 |
| CN | 103069115 | A | 4/2013 |
| DE | 3930157 | A1 | 3/1991 |

(Continued)

OTHER PUBLICATIONS

International Search Report for International Patent Application No. PCT/SE2017050468 dated Aug. 15, 2017.
Written Opinion of the International Searching Authority for International Patent Application No. PCT/SE2017050468 dated Aug. 15, 2017.
Scania CV AB, International Patent Application No. PCT/SE2017/050469, International Preliminary Report on Patentability, dated Dec. 11, 2018.

*Primary Examiner* — Devon C Kramer
*Assistant Examiner* — Kelsey L Stanek
(74) *Attorney, Agent, or Firm* — Moore & Van Allen PLLC; W. Kevin Ransom

(57) ABSTRACT

A variable cam timing phaser arrangement is disclosed, comprising: a rotor having at least one vane; a stator co-axially surrounding the rotor, having at least one recess for receiving the at least one vane, wherein the at least one vane divides the at least one recess into a first and second chambers; and a control assembly for regulating hydraulic fluid flow from the first chamber to the second chamber or vice-versa. The control assembly comprises a first check valve, a second check valve and a selective deactivation device. The check valves are arranged in series in a fluid passage between the first chamber and the second chamber. The selective deactivation device is deployable and is configured to selectively deactivate either the first check valve or the second check valve upon deployment. By timing the deployment of the deactivation device, the direction of flow between the first and second chambers can be controlled.

14 Claims, 6 Drawing Sheets

(56) References Cited

FOREIGN PATENT DOCUMENTS

| | | | | | |
|---|---|---|---|---|---|
| DE | 202004021243 | U1 | | 4/2007 | |
| DE | 102008001801 | A1 | | 11/2009 | |
| DE | 102008002461 | A1 | | 12/2009 | |
| DE | 102011055651 | A1 | | 5/2013 | |
| DE | 102013207616 | A1 | | 10/2014 | |
| DE | 102013207616 | A1 | * | 10/2014 | ..... F01L 1/34409 |
| DE | 102014218547 | A1 | | 3/2016 | |
| EP | 1522684 | A2 | | 4/2005 | |
| EP | 1598528 | A2 | | 11/2005 | |
| WO | WO2006069156 | A1 | | 6/2006 | |
| WO | WO2006127347 | A1 | | 11/2006 | |
| WO | WO2006127348 | A1 | | 11/2006 | |
| WO | WO2012061233 | A2 | | 5/2012 | |
| WO | WO2014173399 | | | 5/2012 | |

* cited by examiner

VARIABLE CAM TIMING PHASER UTILIZING SERIES-COUPLED CHECK VALVES

CROSS-REFERENCE TO RELATED APPLICATIONS

This application is a national stage application (filed under 35 § U.S.C. 371) of PCT/SE2017/050469, filed May 10, 2017 of the same title, which, in turn, claims priority to Swedish Application No. 1650798-0 filed Jun. 8, 2016; the contents of each of which are hereby incorporated by reference.

FIELD OF THE INVENTION

The present invention concerns a variable cam timing phaser arrangement for an internal combustion engine as well as a method for controlling the timing of a camshaft in an internal combustion engine using such a variable cam timing phaser. The invention also concerns an internal combustion engine and a vehicle comprising such a variable cam timing phaser arrangement.

BACKGROUND OF THE INVENTION

The valves in internal combustion engines are used to regulate the flow of intake and exhaust gases into the engine cylinders. The opening and closing of the intake and exhaust valves in an internal combustion engine is normally driven by one or more camshafts. Since the valves control the flow of air into the engine cylinders and exhaust out of the engine cylinders, it is crucial that they open and close at the appropriate time during each stroke of the cylinder piston. For this reason, each camshaft is driven by the crankshaft, often via a timing belt or timing chain. However, the optimal valve timing varies depends on a number of factors, such as engine load. In a traditional camshaft arrangement the valve timing is fixedly determined by the relation of the camshaft and crankshaft and therefore the timing is not optimized over the entire engine operating range, leading to impaired performance, lower fuel economy and/or greater emissions. Therefore, methods of varying the valve timing depending on engine conditions have been developed.

One such method is hydraulic variable cam phasing (hVCP). hVCP is one of the most effective strategies for improving overall engine performance by allowing continuous and broad settings for engine-valve overlap and timing. It has therefore become a commonly used technique in modern compression-ignition and spark-ignition engines.

Both oil-pressure actuated and cam torque actuated hydraulic variable cam phasers are known in the art.

The oil-pressure actuated hVCP design comprises a rotor and a stator mounted to the camshaft and cam sprocket respectively. Hydraulic oil is fed to the rotor via an oil control valve. When phasing is initiated, the oil control valve is positioned to direct oil flow either to an advance chamber formed between the rotor and stator, or a retard chamber formed between the rotor and stator. The resulting difference in oil pressure between the advance chamber and the retard chamber makes the rotor rotate relative to the stator. This either advances or retards the timing of the camshaft, depending on the chosen position of the oil control valve.

The oil control valve is a three-positional spool valve that can be positioned either centrally, i.e. co-axially with the camshaft, or remotely, i.e. as a non-rotating component of the hVCP arrangement. This oil control valve is regulated by a variable force solenoid (VFS), which is stationary in relation to the rotating cam phaser (when the oil control valve is centrally mounted). The variable force solenoid and the spool valve have three operational positions: one to provide oil to the advance chamber, one to provide oil to the retard chamber, and one to refill oil to both chambers (i.e. a holding position).

The established oil pressure actuated hVCP technology is effective in varying valve timing, but has relatively slow phasing velocities and high oil consumption. Therefore, the latest iterations of hVCP technology utilize a technique known as cam torque actuation (CTA). As the camshaft rotates the torque on the camshaft varies periodically between positive torque and negative torque in a sinusoidal manner. The exact period, magnitude and shape of the cam torque variation depends on a number of factors including the number of valves regulated by the camshaft and the engine rotation frequency. Positive torque resists cam rotation, while negative cam torque aids cam rotation. Cam torque actuated phasers utilize these periodic torque variations to rotate the rotor in the chosen direction, thereby advancing or retarding the camshaft timing. In principle they operate as "hydraulic ratchets", allowing fluid to flow in a single direction from one chamber to the other chamber due to the torque acting on the oil in the chambers and causing periodic pressure fluctuations. The reverse direction of fluid flow is prevented by check valve. Therefore, the rotor will be rotationally shifted relative to the stator every period the torque acts in the relevant direction, but will remain stationary when the torque periodically acts in the opposite direction. In this manner, rotor can be rotated relative to the stator, and the timing of the camshaft can be advanced or retarded.

Cam torque actuation systems therefore require check valves to be placed inside the rotor in order to achieve the "hydraulic ratchet" effect. The directing of oil flow to the advance chamber, retard chamber, or both/neither (in a holding position) is typically achieved using a three-positional spool valve. This spool valve can be positioned either centrally, i.e. co-axially with the camshaft, or remotely, i.e. as a non-rotating component of the cam phasing arrangement. The three-positional spool valve is typically moved to each of the three operative positions using a variable force solenoid.

Patent application US 2008/0135004 describes a phaser including a housing, a rotor, a phaser control valve (spool) and a regulated pressure control system (RCPS). The phaser may a cam torque actuated phaser or an oil pressure activated phaser. The RPCS has a controller which provides a set point, a desired angle and a signal bases on engine parameters to a direct control pressure regulator valve. The direct control pressure regulator valve regulates a supply pressure to a control pressure. The control pressure moves the phaser control spool to one of three positions, advance, retard and null, in proportion to the pressure supplied.

There remains a need for improved cam timing phaser arrangements. In particular, there remains a need for cam timing phaser arrangements that are suitable for use commercial vehicles, which are often subject to heavier engine loads and longer service lives as compared to passenger cars.

SUMMARY OF THE INVENTION

The inventors of the present invention have identified a range of shortcomings in the prior art, especially in relation to the use of existing cam phaser arrangements in commercial vehicles. It has been found that the three-positional spool valves of the oil control valve (OCV) in present systems must be precisely regulated and therefore are sensitive to impurities that may jam the spool in a single position. Due to the need for three-position regulation, the solenoids or pressure regulators used in conjunction with the oil control valve must be able to be precisely regulated to provide varying force, in order to attain three positions. This adds considerable mechanical complexity to the system, making it more expensive, more sensitive to impurities and less robust. It also makes the routines for controlling the cam phaser more complex.

It has been observed that that when the oil control valve is solenoid-actuated and centrally mounted the contact between the solenoid-pin and the oil control valve is non-stationary since the oil control valve rotates and the solenoid-pin is stationary. This sliding-contact wears the contact surfaces and the position accuracy of the oil control valve is compromised over the long-term which affects the cam phaser performance. The accuracy of the variable force solenoid itself must also remain high to ensure precise control over the OCV.

Further, oil leakage of existing cam phaser arrangements is also a problem. Cross-port leakage inside the oil control valve cause oil to escape the hydraulic circuit and increase camshaft oscillations due to decreased system stiffness. This leakage also affects the oil consumption of the cam phaser arrangement. It has been observed that the three-positional spool valves used in regulating oil flow offer many different leakage paths for oil to escape the cam phaser chambers. Most noticeable is the sliding contact surface closest to the variable force solenoid where the valve is solenoid-actuated, as well as the port connected to vent. This leakage increases with increased pressure inside the cam phaser chambers since all the pressure spikes in the system must be absorbed by the oil control valve. These pressure spikes are in turn dependent on camshaft torque and may exceed 50 bars for commercial vehicles. Camshaft torques are higher in heavy-duty vehicles, causing higher pressure spikes and even more leakage.

It has been observed that existing cam phasing systems utilising remotely-mounted oil control valves suffer from even greater system leakage because the pressure spikes from the cam phaser must be transmitted through the camshaft journal bearing before reaching the oil control valve, therefore increasing bearing leakage.

Further, it has been found that the rotor of existing cam torque actuated phasing systems is very compact and complex. Specially-designed check valves must be mounted in the rotor in order to fit in conjunction with the oil control valve. Such check valves are less durable than conventional check valves and add additional expense. Moreover, the rotor requires a complex internal hydraulic pipe system. Due to these requirements, the manufacturing of cam torque actuated cam phasers requires special tools and assembling.

Thus, it is an object of the present invention to provide a variable cam timing phaser arrangement utilizing cam torque actuation that is mechanically simpler, more robust and less prone to oil leakage than known cam torque actuated cam phasers.

This object is achieved by the variable cam timing phaser arrangement according to the appended claims.

The variable cam timing phaser arrangement comprises:

a rotor having at least one vane, the rotor arranged to be connected to a camshaft;

a stator co-axially surrounding the rotor, having at least one recess for receiving the at least one vane of the rotor and allowing rotational movement of the rotor with respect to the stator, the stator having an outer circumference arranged for accepting drive force;

wherein the at least one vane divides the at least one recess into a first chamber and a second chamber, the first chamber and the second chamber being arranged to receive hydraulic fluid under pressure, wherein the introduction of hydraulic fluid into the first chamber causes the rotor to move in a first rotational direction relative to the stator and the introduction of hydraulic fluid into the second chamber causes the rotor to move in a second rotational direction relative to the stator, the second rotational direction being opposite the first rotational direction; and a control assembly for regulating hydraulic fluid flow from the first chamber to the second chamber or vice-versa.

The control assembly comprises:

a first check valve, a second check valve and a selective deactivation device; wherein the first check valve and the second check valve are arranged in series in a fluid passage between the first chamber and the second chamber, wherein the first check valve is configured to prevent fluid flow in a first direction from the first chamber to the second chamber and to allow fluid flow in a second direction from the second chamber to the first chamber, and wherein the second check valve is configured to allow fluid flow in the first direction and to prevent fluid flow in the second direction; and wherein the selective deactivation device is deployable and is configured to selectively deactivate either the first check valve or the second check valve upon deployment, depending on the relative fluid pressure between the first chamber and the second chamber, whereby the deactivated first or second check valve allows fluid flow in both the first direction and second direction.

The variable cam timing phaser arrangement described can be used to provide cam phasing by timing the deployment of the selective deactivation device to allow directional fluid flow from one of the chambers to the other, in the desired direction, while preventing flow in the opposite undesired direction.

A variable cam timing phaser arrangement constructed in this manner has a number of advantages. It is constructionally simple, requiring only a single simple on/off valve or solenoid to control to cam phaser. The cam phaser is more robust due to less complex and/or less sensitive hydraulic components compared to other cam torque actuated cam phasers. The use of only constructionally robust on/off actuation and the avoidance of transferal of pressure spikes through the camshaft bearings means that oil escape paths are fewer and oil consumption lower. The risk of valves or solenoids jamming is lowered since any actuating valves or solenoids used need take only two positions, i.e. on/off, meaning that a greater actuating force and/or stronger return mechanisms can be used. More robust solenoids can be used since intermediate position accuracy is not needed. Similarly, no fine multi-pressure regulation is needed to actuate the blocking device. Check-valves can be mounted externally to the cam phaser (i.e. not in the rotor vanes), thus allowing the use of more established and robust check valves. A further advantage is that the rotor component bears a greater similarity to oil-actuated cam phasers which are cheaper to manufacture than known cam torque actuated cam phasers.

The first check valve may be deactivated upon deployment of the selective deactivation device whenever the second chamber has overpressure. The second check valve may be deactivated upon deployment of the selective deactivation device whenever the first chamber has overpressure.

This allows for a constructionally simple deactivation device wherein the "selective" component of the deactivation device is moved in the same direction as the direction of flow arising from the pressure difference between the two chambers.

The first check valve may comprise a first port in fluid communication with the first chamber, a second port in fluid communication with a second port of the second check valve, and a first valve member, wherein the first valve member is configured to allow flow from the second port of the first check valve to the first port of the first check valve, and to prevent flow from the first port of the first check valve to the second port of the first check valve; and wherein the second check valve comprises a first port in fluid communication with the second chamber, a second port in fluid communication with the second port of the first check valve, and a second valve member, wherein the second valve member is configured to allow flow from the second port of the second check valve to the first port of the second check valve, and to prevent flow from the first port of the second check valve to the second port of the second check valve. Thus, the check valves are arranged "face-to-face" meaning that the valve members are not de-seated during the periodic pressure fluctuations encountered in holding mode. The valve members are only moved when phasing the cam phaser. This means that wear on the check valve components is reduced.

The selective deactivation device may comprise at least one deactivation element that is movable from a disengaged position to an engaged position when the deactivation device is deployed, wherein the deactivation device when deployed selectively displaces either the first valve member or the second valve member. This provides a mechanically simple means of selectively deactivating the check valves.

The selective deactivation device of the cam phaser arrangement may comprise:

a cylinder having a first end in fluid communication with the first chamber and a second end in fluid communication with the second chamber;

a cylinder member arranged in the cylinder and arranged to be moveable in a direction along a longitudinal axis of the cylinder between a first cylinder position by fluid pressure whenever the first chamber has overpressure, and a second cylinder position by fluid pressure whenever the second chamber has overpressure, wherein the cylinder member is arranged to be moveable in a radial direction relative to the longitudinal axis of the cylinder when in the first cylinder position or second cylinder position whenever the selective deactivation device is deployed;

a first deactivation element arranged to be moveable to an engaged position by the radial motion of the cylinder member whenever the selective deactivation device is deployed with the cylinder member in the second position, wherein the engaged first deactivation element displaces the first valve member; and a second deactivation element arranged to be moveable to an engaged position by the radial motion of the cylinder member whenever the selective deactivation device is deployed with the cylinder member in the first position, wherein the engaged second deactivation element displaces the second valve member.

Such a deactivation device operates by moving a cylinder member, such as a piston or ball, along the length of a cylinder using fluid pressure. This provides an effective mode of selectively deactivating a single check valve while allowing the other check valve to function as normal, thus obtaining unidirectional flow in the desired direction.

The selective deactivation device may be deployed by increased external hydraulic pressure, by increased external pneumatic pressure, or by energization of a solenoid. Thus, a wide variety of techniques, including remote actuation, may be used in actuating the control assembly.

The selective deactivation device may be deployed by increased external hydraulic pressure, wherein the external hydraulic pressure is regulated by a solenoid-controlled actuator located remotely from any rotating components of the cam timing phaser arrangement. Thus, the use of a bulky central solenoid is avoided and space may be saved at appropriate locations within the internal combustion engine by relocating the actuator to where space is available. The solenoid-controlled actuator is a 3/2 way on/off solenoid valve having an inlet port in fluid communication with a source of increased fluid pressure, an outlet port in fluid communication with the selective deactivation device, and a vent port, wherein the primary state of the solenoid valve is a de-energized state preventing fluid communication from the source of increased fluid pressure to the selective deactivation device and allowing fluid communication from the selective deactivation device to the vent port, and wherein the secondary state of the solenoid valve is an energized state allowing fluid communication from the source of increased fluid pressure to the selective deactivation device and deploying the at least one deactivation element. Such solenoid valves are readily-available, well-established and sufficiently robust to provide reliable service in commercial and heavy vehicle applications. The solenoid valve may be of the poppet-type, which virtually eliminates the risk for valve jam.

The solenoid-controlled actuator may comprise a solenoid-driven plunger arranged in a barrel, the barrel being arranged in fluid communication with the selective deactivation device, wherein the primary state of the solenoid-driven plunger is a retracted de-energized state and the secondary state of the solenoid-driven plunger is an extended energized state, the extended state increasing the pressure of the fluid at the selective deactivation device and deploying the at least one deactivation element. Thus the actuation pressure of the piloted valve need not be dependent on the system oil pressure of the vehicle. Utilising a cylinder actuator, the actuation pressure can be designed to be higher than the oil system pressure, or lower, if desired. This allows for greater system robustness.

The selective deactivation device may be deployed by a stationary mounted on/off solenoid. Such a solenoid need only make wearing contact with the rotating components of the cam phaser arrangement during phasing, meaning that wear and positional degradation of the solenoid is greatly reduced as compared to prior art solutions.

A source of increased fluid pressure may be arranged in fluid communication with the first chamber and/or the second chamber via a refill channel. Thus, the fluid pressure in the cam phaser arrangement can be maintained at an appropriate level, appropriate stiffness is achieved, and camshaft vibration can be minimized.

The hydraulic fluid may be hydraulic oil. The use of hydraulic oil in camshaft phaser arrangements is well-established and reliable.

According to another aspect of the invention, a method for controlling the timing of a camshaft in an internal combustion engine comprising a variable cam timing phaser arrangement as described above is provided. The method comprising the steps:

i. Providing the variable cam timing phaser arrangement having the selective deactivation device in a non-deployed state, thereby preventing fluid communication between the first chamber and the second chamber;

ii. Deploying the selective deactivation device at a time to coincide with the first chamber having overpressure, thereby selectively deactivating the second check valve; or deploying the selective deactivation device at a time to coincide with the second chamber having overpressure, thereby selectively deactivating the first check valve;

iii. Maintaining the deployment of the selective deactivation device thereby allowing fluid to periodically flow in a single direction between the first chamber and the second chamber due to camshaft torque, and preventing fluid flow in the opposite direction, thus rotating the rotor relative to the stator in a chosen direction;

iv. Once the desired rotation of the rotor relative to the stator is obtained, disengaging the selective deactivation device, thereby preventing further fluid communication between the first chamber and the second chamber.

This method provides a simple, reliable way of controlling camshaft phasing, requiring control of only a single on/off actuator and requiring only a single simple timing of the actuation when initiating phasing in a desired direction.

According to a further aspect, an internal combustion engine comprising a variable cam timing phaser arrangement as described above is provided.

According to yet another aspect, a vehicle comprising a variable cam timing phaser arrangement as described above is provided.

Further aspects, objects and advantages are defined in the detailed description below with reference to the appended drawings.

BRIEF DESCRIPTION OF THE DRAWINGS

For the understanding of the present invention and further objects and advantages of it, the detailed description set out below can be read together with the accompanying drawings, in which the same reference notations denote similar items in the various diagrams, and in which.

DETAILED DESCRIPTION OF THE INVENTION

Figure 1:
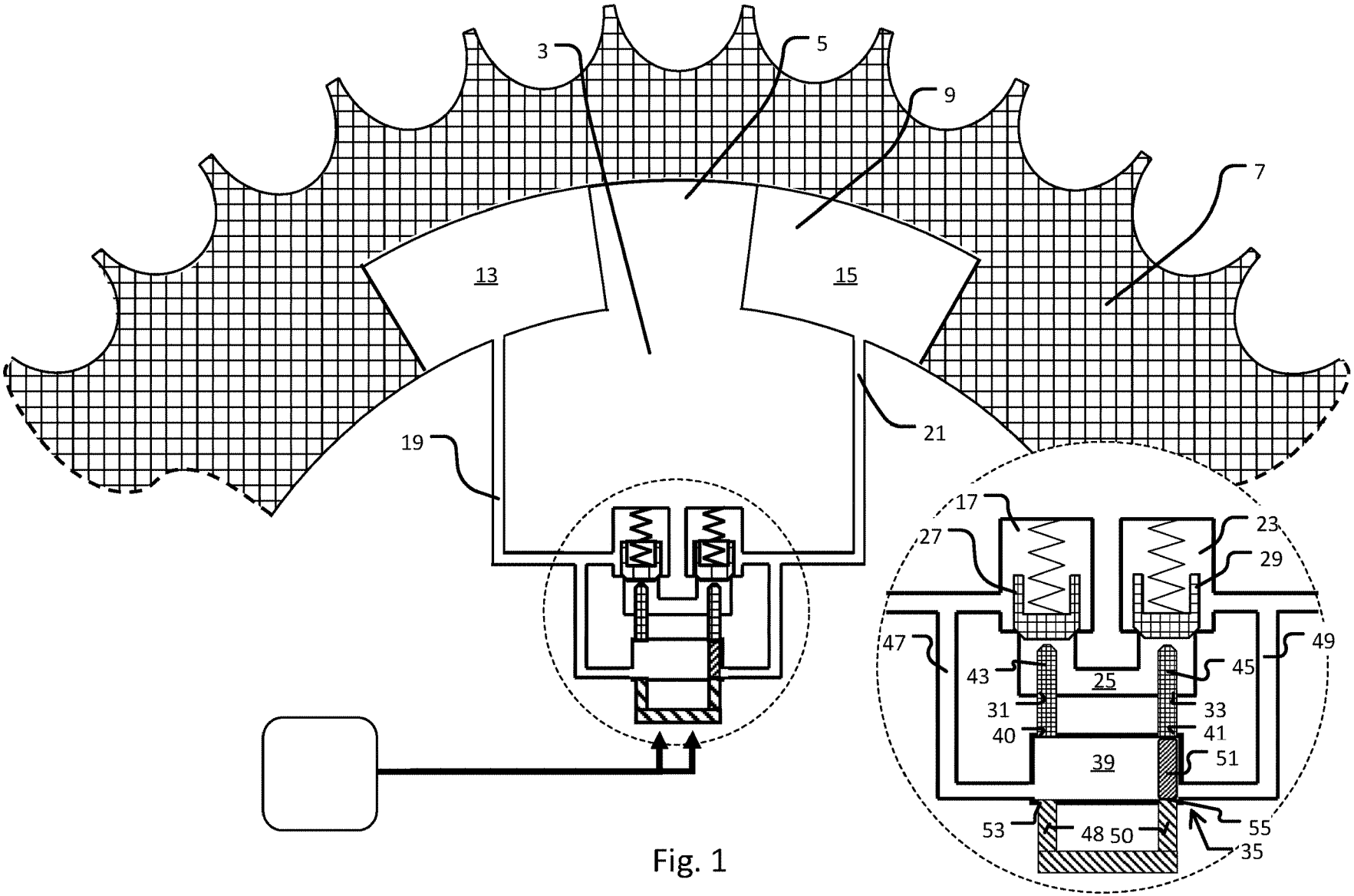
FIG. 1 illustrates schematically one embodiment of a variable cam timing phaser arrangement according to the present disclosure.

The present invention is based on the realization that cam torque actuated cam phasing in both directions can be controlled using a control assembly comprising a selective deactivation device. The selective deactivation device can selectively, depending on the pressure difference between the first chamber and the second chamber, hold either a first check valve or a second check valve open, thus allowing a unidirectional flow path between the two phasing chambers.

The torque experienced by a camshaft alternates periodically between a positive torque, which retards camshaft rotation, and a negative torque, which abets camshaft rotation. This periodically alternating torque in turn leads to a periodically alternating pressure difference between the first chamber and the second chamber, so that initially there is overpressure in the first chamber, then in the second chamber, then in the first chamber, then in the second chamber, and so on and so forth. If the two chambers are in fluid communication, fluid will flow from the higher pressure chamber to the lower pressure chamber, i.e. the direction of flow will periodically alternate. Conventional cam torque actuated (CTA) cam phasers utilize this alternating pressure by providing two separate unidirectional flow paths between the first chamber and the second chamber: a first path allowing only flow from the first chamber to the second chamber, and a second path allowing only flow in the opposite direction, i.e. from the second chamber to the first chamber. By opening one of these flow paths while closing the other, the alternating pressure difference results in unidirectional flow from one chamber to the other by a "hydraulic ratchet" effect.

The cam timing phaser arrangement of the present invention comprises a rotor, a stator co-axially surrounding the rotor, and a control assembly.

The cam phaser rotor is arranged to be connected to a camshaft of the internal combustion engine. This can be an intake valve camshaft, exhaust valve camshaft, or any other camshaft in the engine such as a combined intake/exhaust camshaft. The rotor has at least one vane, but may preferably have a plurality of vanes, such as three, four, five or six vanes. Separate oil channels for channeling oil to and from the control assembly are provided at each side of at least one of the vanes, but preferably at each side of each of the vanes.

The stator is arranged for accepting drive force. This may for example be by connecting the stator to a cam sprocket, which takes up drive force from the crankshaft via the timing belt. The stator may also be constructionally integrated with the cam sprocket. The stator co-axially surrounds the rotor and has at least one recess for accepting the at least one vane of the rotor. In practice, the stator has the same number of recesses as the number of rotor vanes. The recesses in the stator are somewhat larger than the rotor vanes, meaning that when the rotor is positioned in the stator with the vanes centrally positioned in the recesses, a chamber is formed at each side of each rotor. These chambers can be characterised as first chambers, rotating the rotor in a first direction relative to the stator when filled with hydraulic oil, and second chambers, rotating the rotor in a second direction relative to the stator when filled with hydraulic oil.

The control assembly of the present disclosure comprises a first check valve, a second check valve and a selective deactivation device. The control assembly may be located centrally within the rotor and/or camshaft of the cam phaser arrangement. The components of the control assembly may be separate discrete components, or they may be partially or fully integrated. For example, the first and second check valves may share a valve body.

Where valves or actuators are referred to as "on/off" this refers to a valve or actuator having only two states: an open state and a closed state. Such valves may however have more than two ports. For example, a 3/2 way on/off valve has three ports and two states. Such a valve often connects two flow ports when open and connects one of the flow ports to a vent/exhaust port when closed.

Where valves are referred to as "normally closed/open/on/off", this refers to the state of the valve when non-actuated. For example, a normally open solenoid valve is held in the open position when not actuated/energized, commonly using a return such as a spring return. When the normally open solenoid valve is actuated/energized the solenoid acts with a force sufficient to overcome the force of the return holding the valve open, and the valve is therefore closed. Upon de-actuation/de-energization, the return returns the valve to the open state.

Where components are stated to be in "fluid communication" or flow is allowed or prevented "between" components, this flow is to be interpreted as not necessarily directional, i.e. flow may proceed in either direction. Directional flow in a single direction is denoted as flow "from" a component "to" another component.

Where a said chamber is referred to as having overpressure, this means that the fluid pressure in the said chamber is higher than the fluid pressure in the other chamber. For instance, if the first chamber is stated to have overpressure, this means that the pressure in the first chamber is higher than in the second chamber.

The first and second check valves are arranged in series in a flow path leading from the first chamber to the second chamber. Hydraulic fluid, such as oil, can flow in two directions in this flow path: a first direction from the first chamber to the second chamber, or a second direction, from the second chamber to the first. The two check valves face in opposite directions, so that the first check valve prevents flow in the first direction but allows flow in the second direction, whereas the second check valve allows flow in the first direction but prevents flow in the second direction. The check valves may be arranged "face-to-face" whereby fluid flow is prevented by the first encountered check valve when flowing between the first and second chambers. Alternatively, the check valves may be arranged "back-to-back" whereby fluid flow may pass the initially encountered check valve before being prevented by the next encountered check valve.

The check valves can be of any construction known in the art. For example, check valves having a ball valve member, lift valve member, diaphragm valve member or disc valve member may be used. The check valves may be provided with return mechanisms such as springs, or the valve members may be returned to the seated position by gravity or fluid pressure acting in the opposite direction to the permitted direction. In order to simplify the design of the selective deactivation device, the check valves may be arranged so that the force required for deactivating the first check valve is of the same magnitude and acts in the same direction as for the second valve. This can be achieved, for example, by using two identical lift check valves as the first and second check valves.

The check valves are capable of being deactivated by a selective deactivation device. By deactivation it is meant that the valve member of the check valve is de-seated thus allowing flow in both the first and second directions. The mechanism of deactivation may vary. For example, the check valves may be deactivated by "pushing" on the valve member in the direction required to de-seat the valve member. Alternatively, if the valve member is fixed to a valve stem, deactivation may be provided by "pushing", "pulling" or rotating the valve stem.

The selective deactivation device is responsive to the pressure difference between the first and second chambers and is capable of selectively deactivating either the first check valve or the second check valve, depending on which of the chambers has overpressure. By selectively deactivating one of the two check valves, a unidirectional flow path in the desired direction is established between the first chamber and the second chamber.

The selective deactivation device is arranged in conjunction with the two check valves. By this, it is meant that at least some component of the selective deactivation device must be capable of de-seating the valve members of the check valves. Other components of the selective deactivation device may be located remotely from the check valves. The selective deactivation device may be manufactured as a separate component to the check valves or may be partially or completely integrated with one or both check valves. For example, any deactivation elements and closely associated components may be integrated with the check valve bodies, while components required for actuating the deactivation elements may be remotely located.

The selective deactivation device may, for example, comprise a cylinder fluidly coupled in parallel over the two check valves. The cylinder has a cylinder member, such as a piston or ball, which is pushed in the first direction by overpressure in the first chamber until it reaches the second end of the cylinder, or is pushed in the second direction by overpressure in the second chamber until it reaches the first end of the cylinder. A first deactivation element extends through the side wall at the first end of the cylinder and a second deactivation element extends through the side wall at the second end of the cylinder. These deactivation elements are positioned so that upon deployment they engage with and de-seat the valve member of the first and second check valve respectively, thus deactivating the respective valves. The deactivation elements are deployed by the cylinder member being pressed radially outwards from the cylinder by an actuation member positioned on the opposite side of the cylinder to the deactivation elements. The force from the actuation member is transmitted via the cylinder member to the deactivation member, which is moved to an engaged position. This means that it is only the deactivation member aligned with the cylinder member that is deployed upon movement of the actuation member. The deactivation member at the opposite end of the cylinder from the cylinder member remains unmoved. In this manner, a pressure-selective deactivation of the first check valve or second check valve is obtained.

Which check valve corresponds to the first end and second end of the cylinder depends on whether the check valves are arranged "face-to-face" or "back-to-back". If the check valves are arranged "face-to-face" the unidirectional flow direction enabled upon deployment of the deactivation device is the opposite direction to the flow direction prevailing when the selective deactivation device is deployed. If the check valves are arranged "back-to-back" the unidirectional flow direction enabled upon deployment of the deactivation device is the same direction to the flow direction prevailing when the selective deactivation device is deployed. Note that if the check valves are arranged "back-to-back" the de-seating force acting on the valve member must be sufficient to overcome the fluid pressure acting to re-seat the valve member.

The pressures generated by camshaft torque are large and the cylinder member is easily moveable. Therefore, the shuttling of the cylinder member between opposite ends of the cylinder is momentary. Since the camshaft torque varies periodically with the crank angle and shuttling is rapid, the cylinder member position also varies with crank angle and the deactivation of the chosen check valve is therefore simple to time as desired. Once deactivation is initiated, the check valve is continually deactivated until deactivation is ended and therefore timing of the deployment of the selective deactivation device must be performed only once for each phasing operation.

The selective deactivation device may be pressure-actuated or directly actuated by solenoid, and therefore it may be a hydraulic device, pneumatic device or solenoid device. For example, if the selective deactivation device is deployed by elevated fluid pressure, such as air pressure or oil pressure, the components of the selective deactivation device that control the fluid pressure may be located remotely from the rotating components of the cam phaser arrangement and may instead be placed on a stationary component of the internal combustion engine such as the cam bearing holder. The fluid pressure to the selective deactivation device may for example be regulated by an on/off solenoid valve that increases fluid pressure by connection to a source of fluid pressure, such as the main oil gallery if oil is used as the actuating fluid. Such a solenoid valve may for example be a 3-port, 2-position on/off solenoid valve being connected to an oil gallery at the inlet port, at the outlet port being connected to an oil channel leading to the selective deactivation device, and having a vent port for release of oil pressure from the channel leading to the selective deactivation device when in the "off" position. The solenoid valve may normally be in the "off" position when the solenoid is not actuated, and switch to the "on" position upon activation of the solenoid. The solenoid valve may be any suitable valve type known in the art, including but not limited to a poppet valve, sliding spool valve and rotary spool valve. The use of a poppet valve virtually eliminates the risk for valve jam.

An oil-filled barrel in fluid connection with the selective deactivation device may be used as the source of fluid pressure. An on/off solenoid-actuated plunger is provided in the barrel. The solenoid-actuated piston may push down on the volume of oil in the barrel upon actuation, leading to increased pressure at the selective deactivation device.

The oil pressure may be maintained in the cam phaser system by connection to a source of oil pressure, such as the main oil gallery. For example, the fluid channel between the first check valve and second check valve may be fluidly connected to a source of oil pressure. The oil refill channel connecting to the source of oil pressure may be provided with a check valve to prevent backflow of oil from the cam phaser assembly to the source of oil pressure.

The cam phaser assembly may also be provided with a number of failsafe features. A pressure-actuated lock pin may be arranged in at least one of the vanes of the rotor, together with a corresponding recess in the stator for receiving the lock pin. The recess for receiving the locking pin is located at a base position, i.e. either fully advanced or fully retarded. A torsion spring may be provided in order to bias the rotor towards the base position in the event of system failure. The lock pin is normally in the deployed (locking) position, and is actuated to the retracted (unlocked) position when the pressure in a component of the cam phaser arrangement exceeds a threshold pressure. For example, the lock pin may be in fluid connection with one or more channels leading from a chamber to the control assembly. The lock pin may alternatively be in fluid connection with an oil refill channel.

Another failsafe feature that can be utilized is a pilot check valve arranged in a channel bypassing the two check valves. The pilot port of this piloted check valve is in fluid communication with a pressurized channel in the cam phaser system, for example an oil refill channel. When oil pressure in the system is over a threshold level, i.e. oil pressure is normal, the piloted check valve prevents flow in both directions in the bypass channel, i.e. the bypass is closed and the cam phaser arrangement functions as previously described. However, if the oil pressure in the system falls below the threshold level, indicating for example a system failure, the piloted check valve acts to allow flow in a single direction and prevent flow in the opposite direction. Therefore, the rotor will be directed towards the locking base position by the action of camshaft torque. Thus, by using such a pilot check valve failsafe measure, the need for a failsafe torsional spring in the rotor is removed, thus allowing the cam phaser to utilize more of the camshaft torque.

During normal operation without cam phasing, the selective deactivation device is not deployed and no fluid flows between the first chamber and the second chamber due to the first check valve blocking flow in the first direction and the second check valve blocking flow in the second direction. When camshaft phasing is desired, the deployment of the selective deactivation device is timed to coincide with the pressure difference between chambers providing deactivation of the desired check valve. So, for example, if hydraulic fluid flow is desired from the first chamber to the second, the deployment of the selective deactivation device is timed to provide deactivation of the first check valve. As the camshaft torque periodically fluctuates, fluid will now be allowed to flow from the first chamber to the second chamber, but will still be prevented from flowing from the second chamber to the first chamber by the second check valve. Therefore, unidirectional flow will be obtained and the rotor will rotate relative to the stator in a first direction, i.e. cam phasing will occur.

The invention will now be further illustrated with reference to the figures.

FIG. 1 shows one embodiment of the disclosed variable cam timing phaser arrangement. A rotor 3 comprises at least one vane 5. The rotor is fixed to a camshaft (not shown). A stator 7 having at least one recess 9 co-axially surrounds the rotor 3. The stator is fixed to a cam sprocket (not shown). The vane 5 divides the recess 9 into a first chamber 13 and a second chamber 15. A first oil channel 19 is arranged at the side of the vane 5 and leads from the first chamber 13 to a first port of the first check valve 17. A second oil channel 21 is arranged at the side of the vane 5 and leads from the second chamber 15 to a first port of the second check valve 23. A third oil channel 25 connects the second port of the first check valve 17 to the second port of the second check valve 23.

A first valve member 27 is arranged within the first check valve 17 to allow flow from the second port to the first port and to prevent flow from the first port to the second port. A second valve member 29 is arranged within the second check valve 23 to allow flow from the second port to the first port and to prevent flow from the first port to the second port.

Two orifices 31, 33 are provided through the wall of the third oil channel 25 for receiving the deactivation elements of a deactivation device 35. The orifices 31, 33 are provided on a side of the third oil channel wall that is in proximity to the deactivation device 35. A first orifice 31 is arranged through the wall of the oil channel in a position directly facing the face of the first valve member 27. A second orifice 33 is arranged through the wall of the oil channel in a position directly facing the face of the second valve member 29.

A deactivation device 35 is provided in close proximity to a side wall of the third oil channel 25. The deactivation device comprises a cylinder 39 having a first end arranged in fluid connection with the first oil channel 19 by a fourth oil channel 47, and a second end in fluid connection with the second oil channel 21 by a fifth oil channel 49. The cylinder 39 and third oil channel 25 are aligned so that the first end of the cylinder is positioned outside and in line with the first orifice 31 of the third oil channel, and the second end of the cylinder is positioned outside and in line with the second orifice 33 of the third oil channel.

The cylinder 39 has a first orifice 40, located at the first end on a side of the cylinder 39 facing the third oil channel 25, and corresponding positionally to the first orifice 31 of the third oil channel 25. A first deactivation pin 43 runs between the first orifice 40 of the cylinder 39 and the first orifice 31 of the third oil channel 25. The first deactivation pin 43 is dimensioned suitably to be able to slide through the first orifice 31 of third oil channel 25. One end of the deactivation pin 43 forms a sealing engagement with the first orifice 40 of the cylinder 39, and a second end is in immediate proximity to the face of the first valve member 27. The body of the deactivation pin 43 forms a sealing engagement with the first orifice 35 of the third oil channel 25.

The cylinder 39 has a second orifice 41, located at the second end on a side of the cylinder 39 facing the third oil channel 25, and corresponding positionally to the second orifice 33 of the third oil channel 25. A second deactivation pin 45 runs between the second orifice 41 of the cylinder 39 and the second orifice 33 of the third oil channel 25. The second deactivation pin 45 is dimensioned suitably to be able to slide through the second orifice 33 of the third oil channel 25. One end of the second blocking pin 45 forms a sealing engagement with the second orifice 41 of the cylinder 39, and a second end is in immediate proximity to the face of the second valve member 29. The body of the deactivation pin 45 forms a sealing engagement with the second orifice 33 of the third oil channel 25. Thus, the first and second deactivation pins prevent leakage of oil and loss of fluid pressure through orifices 31, 33, 40 and 41.

The cylinder has a third orifice 53 located at the first end of the cylinder 39, radially opposite the first orifice 40. A first end of a first actuating pin 48 forms a sealing engagement with the third orifice 53. The first actuating pin 48 is dimensioned suitably to be able to slide through the third orifice 53. The body of the first actuating pin 48 is on the outside of the cylinder 39 when the deactivation device 35 is not actuated.

The cylinder has a fourth orifice 55 located at the second end of the cylinder 39, radially opposite the second orifice 41. A first end of a second actuating pin 50 forms a sealing engagement with the fourth orifice 55. The second actuating pin 50 is dimensioned suitably to be able to slide through the fourth orifice 55. The body of the second actuating pin 50 is on the outside of the cylinder 39 when the blocking device 37 is not actuated.

A piston 51 is arranged in the cylinder 39 and is moveable by fluid pressure between a first position and a second position in response to fluid pressure. The first position is at the second end of the cylinder 39, in between the second deactivation pin 45 and the second actuating pin 50. The second position is at the first end of the cylinder 39, in between the first deactivation pin 43 and the first actuating pin 48. The piston 51 is dimensioned to be able to fit through the orifices 40 and 41 in order to displace deactivation pins 43 and 45 towards the valve members 27, 29 whenever the deactivation device 37 is actuated.

Figure 2A:
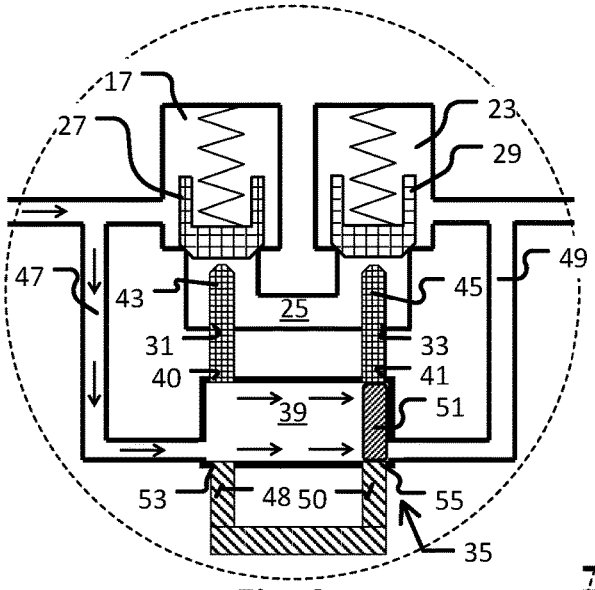
FIG. 2*a* illustrates schematically one embodiment of a control assembly of a variable cam timing phaser arrangement in a first state.
Figure 2B:
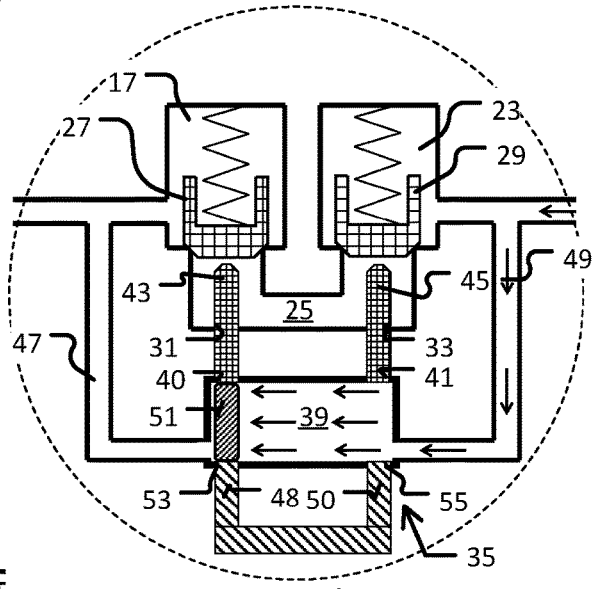
FIG. 2*b* illustrates schematically one embodiment of a control assembly of a variable cam timing phaser arrangement in a second state.

The cam timing phaser arrangement functions as follows. Whenever oil pressure is higher in the first chamber 13 than in the second chamber 15, the piston 51 is moved by fluid pressure to the first position (at the second end of the cylinder 39). Oil flow is prevented by the first check valve 17. This first closed state of the control assembly of the cam phaser arrangement is shown in FIG. 2*a*. Whenever oil pressure is higher in the second chamber 15 than in the first chamber 13, the piston 51 is moved by fluid pressure to the second position (at the first end of the cylinder 39). Oil flow is prevented by the second check valve 23. This second closed state of the control assembly of the cam phaser arrangement is shown in FIG. 2*b*. Thus, when unactuated, the control assembly prevents flow in both directions, i.e. is in a cam phase holding mode. Note however that the piston 51 takes two separate positions depending on the direction that the pressure difference that the two chambers 13, 15 works in. This feature is exploited to provide phasing in the desired direction.

Figure 2C:
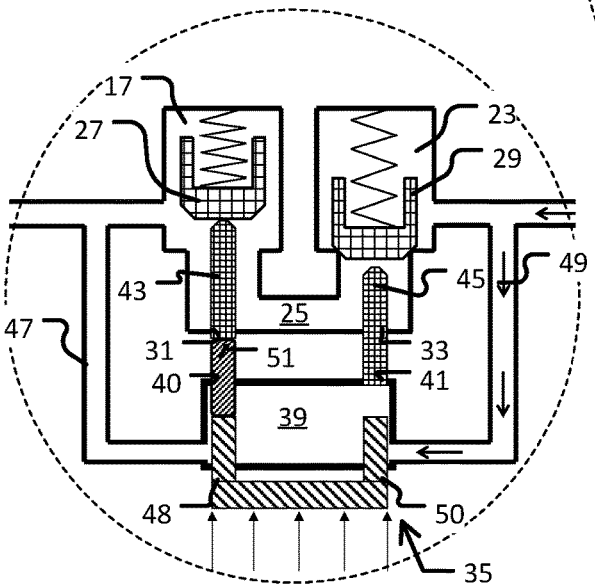
FIG. 2*c* illustrates schematically one embodiment of a control assembly of a variable cam timing phaser arrangement when a deactivation device is activated during a second state.
Figure 2D:
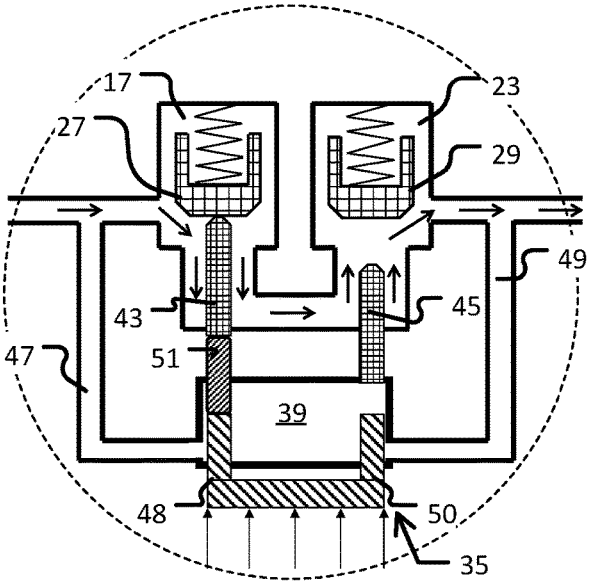
FIG. 2*d* illustrates schematically one embodiment of a control assembly of a variable cam timing phaser arrangement in an open state.

If phasing is desired in a first direction, i.e. fluid flow is desired from the first chamber to the second chamber, the deactivation device 35 is deployed during a period when the second chamber has overpressure. Thus, the piston 51 is in the second position. When the deactivation device is deployed, the actuating pins 48, 50 are moved into the cylinder 39 by an actuating force. This actuating force may be fluid pressure or a force provided by the movement of a solenoid. The piston, being in the second position, is pressed by the first actuation pin 48 through the first cylinder orifice 40. The piston in turn pushes the first deactivation pin 43 further through the first orifice 31 against the first valve member 27, thus de-seating the first valve member 27. At the opposite end of the cylinder, the second actuation pin 50 moves into the cylinder volume. However, this motion is not transmitted further to the deactivation pin 45 since the piston 51 is not in the relevant position between the pins 50, 45. Thus the first deactivation pin 43 is moved to a position in engagement with the first valve member 27, while the second blocking pin 45 is not moved and therefore not engaged. This is shown In FIG. 2*c*. When the camshaft torque now fluctuates so that pressure acts in the opposite direction and the first chamber 13 has overpressure, the first check valve 17 is held open by the first deactivation pin 43 and the second check valve 23 is opened by the advancing fluid pressure. Thus, fluid is allowed to flow from the first chamber 13 to the second chamber 15 via the control assembly. Flow is checked in the opposite direction by the second check valve 23. Therefore, unidirectional flow will be allowed from the first chamber 13 to the second chamber 15 as long as the deactivation device 35 is deployed. This is shown in FIG. 2*d*.

Upon removing the actuating force from the actuating pins 48, 50, the deactivation pins 43, 45 and actuating pins 48, 50 will return to their non-actuated state, the piston 51 will be returned to the cylinder 39, and the cam phaser will return to its non-actuated, cam phasing holding state.

Phasing is obtained in an analogous manner in the opposite direction by deploying the deactivation device 35 when the piston 51 is in the first position.

Figure 3:
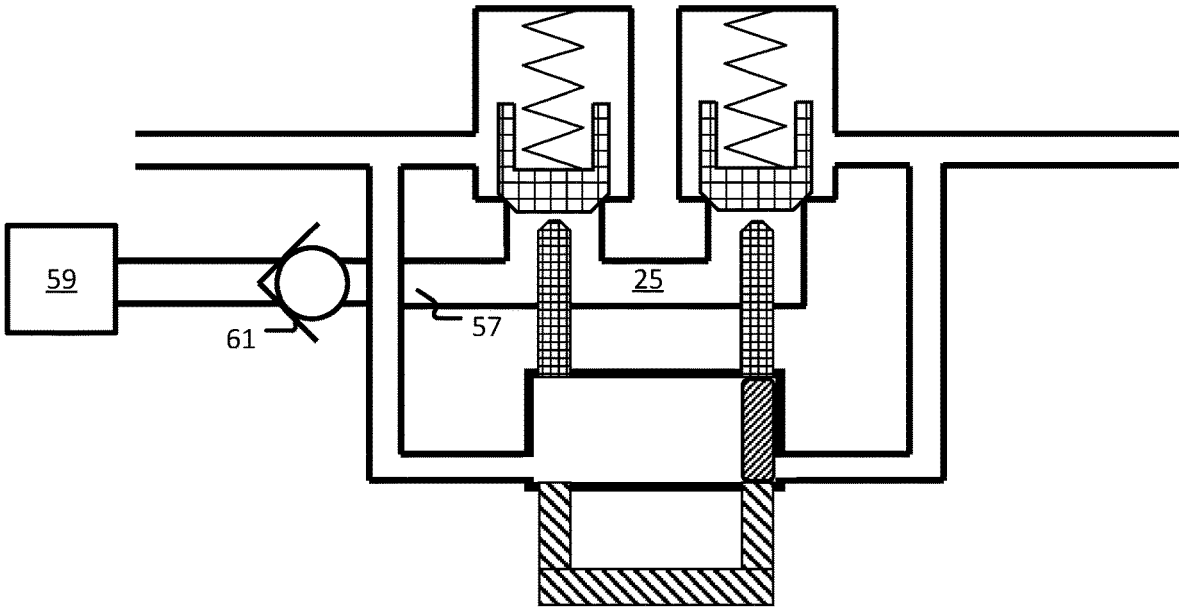
FIG. 3 illustrates schematically another embodiment of a control assembly of variable cam timing phaser arrangement according to the present disclosure.

FIG. 3 shows another embodiment of the control assembly of the cam timing phaser arrangement. In this embodiment, an oil refill channel 57 provides a fluid connection between the third oil channel 25 and a source of oil pressure 59, such as the main oil gallery. The oil refill channel 57 is provided with a check valve 61 in order to prevent backflow of oil from the cam phaser arrangement to the source of oil pressure 59.

Figure 4A:
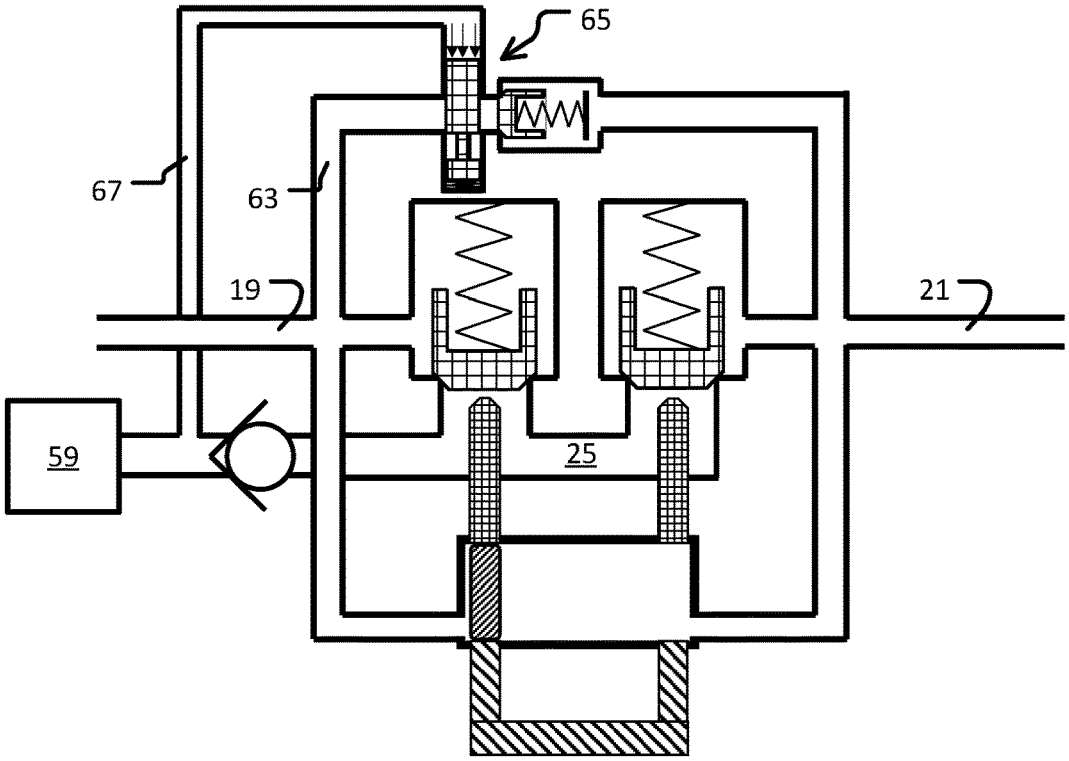
FIG. 4*a* illustrates schematically a further embodiment of a control assembly of variable cam timing phaser arrangement whenever system oil pressure is normal.
Figure 4B:
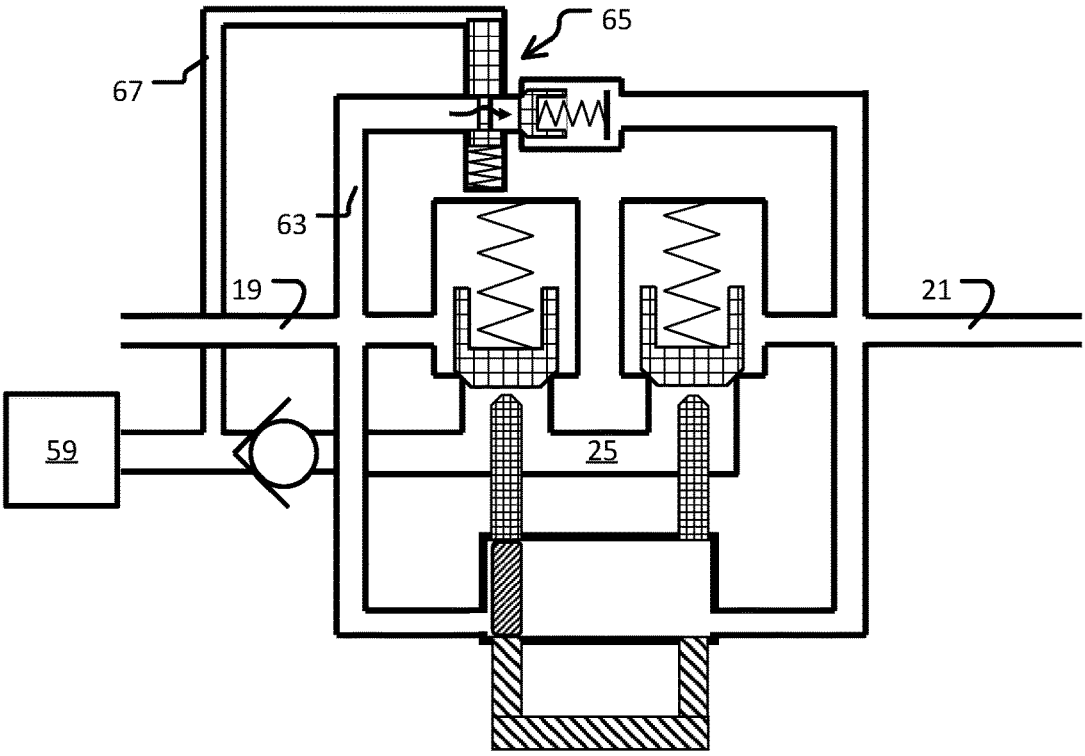
FIG. 4*b* illustrates schematically a further embodiment of a control assembly of variable cam timing phaser arrangement whenever system oil pressure is decreased.

FIGS. 4*a* and 4*b* shows a further embodiment of the control assembly of the cam timing phaser arrangement. In this embodiment, a bypass channel 63 is provided in fluid communication with the first oil channel 19 and second oil channel 21. A pilot check valve 65 is arranged in the bypass channel 63. The pilot check valve 65 has a pilot port in fluid communication with a source of oil pressure 59 via a pilot oil channel 67. FIG. 4*a* shows the control assembly whenever the source of oil pressure 59 provides normal oil pressure. The pilot check valve 65 is closed by the fluid pressure of the oil pressure source 59, thereby preventing flow in the bypass channel 63 in both directions. The control assembly therefore functions as previously described for embodiments lacking a bypass channel 63. The control assembly in the event of oil pressure failure is shown in FIG. 4*b*. Oil pressure in the pilot channel 67 can now no longer close the piloted check valve 65, and the piloted check valve 65 instead functions as a regular check valve. Thus, the piloted check valve 65 allows flow from the first oil channel 19 to the second oil channel 21, but prevents flow in the reverse direction. Thus, the bypass channel 63 provides a unidirectional flow path from the first chamber to the second chamber, providing cam phasing in a first direction and returning the rotor to base position without the need for a torsional spring, even when the deactivation device 35 is non-operational.

Figure 5:
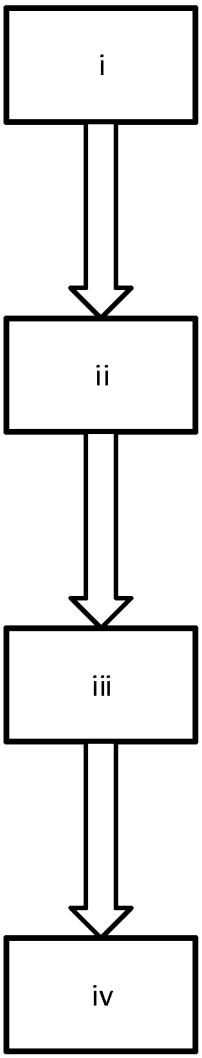
FIG. 5 shows a process flow diagram for a method for controlling the timing of a camshaft in an internal combustion engine according to the present disclosure.

FIG. 5 shows a process flow diagram for a method of controlling the timing of a camshaft in an internal combustion engine comprising a variable cam timing phaser arrangement as disclosed.

In a first step, the cam timing phaser arrangement is provided having the deactivation device in a disengaged position, thereby preventing fluid communication between the first chamber and the second chamber; i.e. the cam phaser arrangement is initially in a cam phasing holding state.

In a second step, the deactivation device is deployed to coincide with the fluid pressure acting in the opposite direction to the direction of phasing desired. This means that a deactivation element will be moved to the engaged position to hold open either the first or second check valve.

In a third step, the deployment of the deactivation device is maintained. During this time, the fluctuating camshaft torque will lead to alternating pressure peaks in the first and second chambers, and the non-deactivated check valve will allow fluid flow in a single direction, thus attaining directional flow from one chamber to the other.

In a fourth step, the deactivation device is disengaged once the desired degree of camshaft phasing is obtained. By disengaging the deactivation device, the cam timing phaser arrangement is returned to the holding state.

Figure 6:
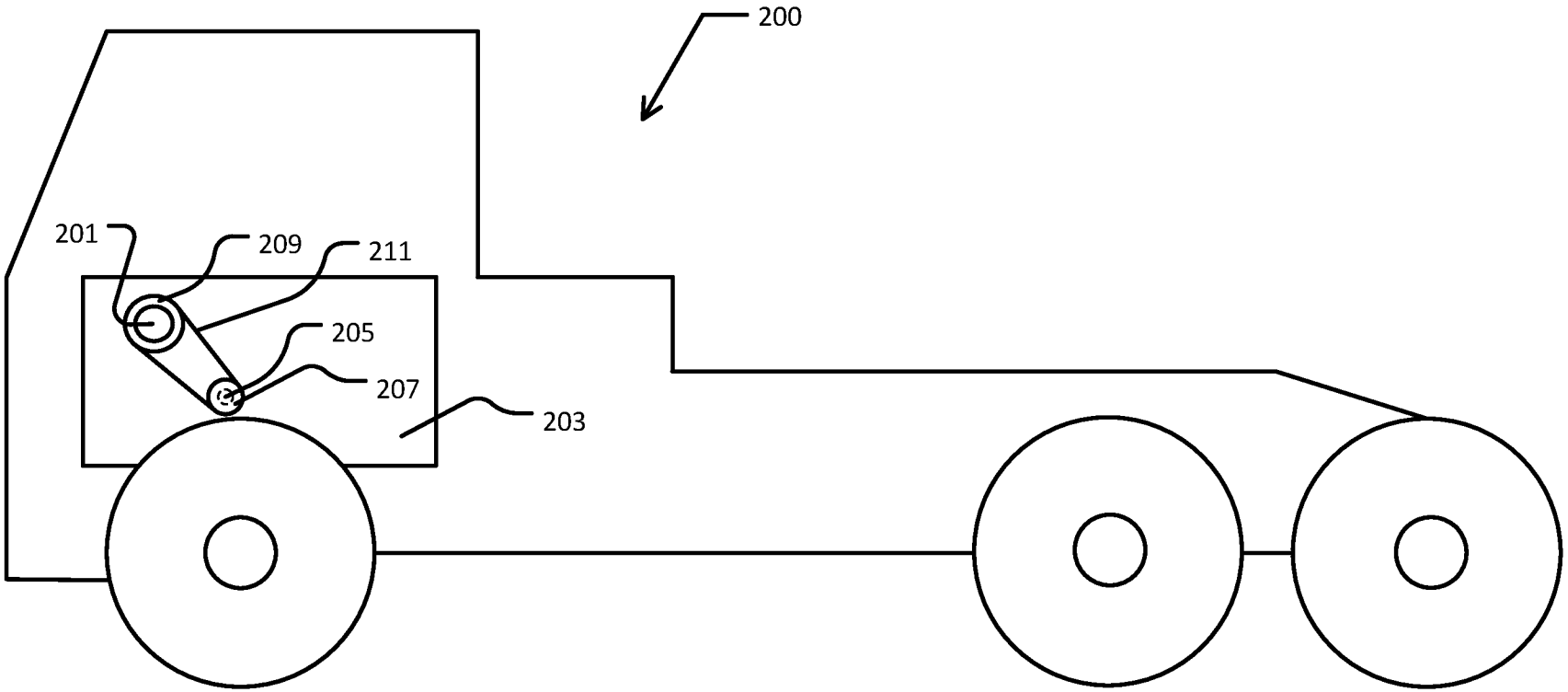
FIG. 6 illustrates schematically a vehicle comprising an internal combustion engine comprising a variable cam timing phaser arrangement according to the present disclosure.

The present invention also relates to an internal combustion engine and a vehicle comprising a variable cam timing phaser arrangement as described above. FIG. 6 shows schematically a heavy goods vehicle 200 having an internal combustion engine 203. The internal combustion engine has a crankshaft 205, crankshaft sprocket 207, camshaft (not shown), camshaft sprocket 209 and timing chain 211. The variable cam timing phaser arrangement 201 is located at the rotational axis of the cam sprocket/camshaft. An engine provided with such a variable cam timing phaser arrangement has a number of advantages such as better fuel economy, lower emissions and better performance as compared to a vehicle lacking cam phasing.

The invention claimed is:

1. A variable cam timing phaser arrangement for an internal combustion engine comprising:

a rotor having at least one vane, the rotor arranged to be connected to a camshaft;

a stator co-axially surrounding the rotor, having at least one recess for receiving the at least one vane of the rotor and allowing rotational movement of the rotor with respect to the stator, the stator having an outer circumference arranged for accepting drive force, wherein the at least one vane divides the at least one recess into a first chamber and a second chamber, the first chamber and the second chamber being arranged to receive hydraulic fluid under pressure, wherein the introduction of hydraulic fluid into the first chamber causes the rotor to move in a first rotational direction relative to the stator and the introduction of hydraulic fluid into the second chamber causes the rotor to move in a second rotational direction relative to the stator, the second rotational direction being opposite the first rotational direction; and a control assembly for regulating hydraulic fluid flow from the first chamber to the second chamber or vice-versa, wherein the control assembly comprises:

a first check valve;

a second check valve; and a selective deactivation device, wherein the first check valve and the second check valve are arranged in series in a fluid passage between the first chamber and the second chamber, wherein the first check valve is configured to prevent fluid flow in a first direction from the first chamber to the second chamber and to allow fluid flow in a second direction from the second chamber to the first chamber, and wherein the second check valve is configured to allow fluid flow in the first direction and to prevent fluid flow in the second direction, wherein the selective deactivation device is deployable and is configured to selectively deactivate either the first check valve or the second check valve upon deployment, depending on the relative fluid pressure between the first chamber and the second chamber, whereby the deactivated first or second check valve allows fluid flow in both the first direction and second direction, and wherein the first check valve is deactivated upon deployment of the selective deactivation device whenever the second chamber has overpressure, and wherein the second check valve is deactivated upon deployment of the selective deactivation device whenever the first chamber has overpressure.

2. The variable cam timing phaser arrangement according to claim 1, wherein the hydraulic fluid is hydraulic oil.

3. A variable cam timing phaser arrangement for an internal combustion engine comprising:

a rotor having at least one vane, the rotor arranged to be connected to a camshaft;

a stator co-axially surrounding the rotor, having at least one recess for receiving the at least one vane of the rotor and allowing rotational movement of the rotor with respect to the stator, the stator having an outer circumference arranged for accepting drive force, wherein the at least one vane divides the at least one recess into a first chamber and a second chamber, the first chamber and the second chamber being arranged to receive hydraulic fluid under pressure, wherein the introduction of hydraulic fluid into the first chamber causes the rotor to move in a first rotational direction relative to the stator and the introduction of hydraulic fluid into the second chamber causes the rotor to move in a second rotational direction relative to the stator, the second rotational direction being opposite the first rotational direction; and a control assembly for regulating hydraulic fluid flow from the first chamber to the second chamber or vice-versa, wherein the control assembly comprises:

a first check valve;

a second check valve; and a selective deactivation device, wherein the first check valve and the second check valve are arranged in series in a fluid passage between the first chamber and the second chamber, wherein the first check valve is configured to prevent fluid flow in a first direction from the first chamber to the second chamber and to allow fluid flow in a second direction from the second chamber to the first chamber, and wherein the second check valve is configured to allow fluid flow in the first direction and to prevent fluid flow in the second direction, wherein the first check valve comprises a first port in fluid communication with the first chamber, a second port, and a first valve member, wherein the first valve member is configured to allow flow from the second port of the first check valve to the first port of the first check valve, and to prevent flow from the first port of the first check valve to the second port of the first check valve; and wherein the second check valve comprises a first port in fluid communication with the second chamber, a second port in fluid communication with the second port of the first check valve, and a second valve member, wherein the second valve member is configured to allow flow from the second port of the second check valve to the first port of the second check valve, and to prevent flow from the first port of the second check valve to the second port of the second check valve, and wherein the selective deactivation device is deployable and is configured to selectively deactivate either the first check valve or the second check valve upon deployment, depending on the relative fluid pressure between the first chamber and the second chamber, whereby the deactivated first or second check valve allows fluid flow in both the first direction and second direction.

4. The variable cam timing phaser arrangement according to claim 3, wherein the selective deactivation device comprises at least one deactivation element that is movable from a disengaged position to an engaged position when the selective deactivation device is deployed, wherein the selective deactivation device when deployed selectively displaces either the first valve member or the second valve member.

5. The variable cam timing phaser arrangement according to claim 4, wherein the selective deactivation device comprises:

a cylinder having a first end in fluid communication with the first chamber and a second end in fluid communication with the second chamber;

a cylinder member arranged in the cylinder and arranged to be moveable in a direction along a longitudinal axis of the cylinder between a first cylinder position by fluid pressure whenever the first chamber has overpressure, and a second cylinder position by fluid pressure whenever the second chamber has overpressure, wherein the cylinder member is arranged to be moveable in a radial direction relative to the longitudinal axis of the cylinder when in the first cylinder position or second cylinder position whenever the selective deactivation device is deployed;

a first deactivation element arranged to be moveable to an engaged position by the radial motion of the cylinder member whenever the selective deactivation device is deployed with the cylinder member in the second position, wherein the engaged first deactivation element displaces the first valve member; and a second deactivation element arranged to be moveable to an engaged position by the radial motion of the cylinder member whenever the selective deactivation device is deployed with the cylinder member in the first position, wherein the engaged second deactivation element displaces the second valve member.

6. A variable cam timing phaser arrangement, for an internal combustion engine comprising:

a rotor having at least one vane, the rotor arranged to be connected to a camshaft;

a stator co-axially surrounding the rotor, having at least one recess for receiving the at least one vane of the rotor and allowing rotational movement of the rotor with respect to the stator, the stator having an outer circumference arranged for accepting drive force, wherein the at least one vane divides the at least one recess into a first chamber and a second chamber, the first chamber and the second chamber being arranged to receive hydraulic fluid under pressure, wherein the introduction of hydraulic fluid into the first chamber causes the rotor to move in a first rotational direction relative to the stator and the introduction of hydraulic fluid into the second chamber causes the rotor to move in a second rotational direction relative to the stator, the second rotational direction being opposite the first rotational direction; and a control assembly for regulating hydraulic fluid flow from the first chamber to the second chamber or vice-versa, wherein the control assembly comprises:

a first check valve;

a second check valve; and a selective deactivation device, wherein the first check valve and the second check valve are arranged in series in a fluid passage between the first chamber and the second chamber, wherein the first check valve is configured to prevent fluid flow in a first direction from the first chamber to the second chamber and to allow fluid flow in a second direction from the second chamber to the first chamber, and wherein the second check valve is configured to allow fluid flow in the first direction and to prevent fluid flow in the second direction, wherein the selective deactivation device is deployable and is configured to selectively deactivate either the first check valve or the second check valve upon deployment, depending on the relative fluid pressure between the first chamber and the second chamber, whereby the deactivated first or second check valve allows fluid flow in both the first direction and second direction, and wherein the selective deactivation device is deployed by increased external hydraulic pressure, by increased external pneumatic pressure, or by energization of a solenoid.

7. The variable cam timing phaser arrangement according to claim 6, wherein the selective deactivation device is deployed by increased external hydraulic pressure and the external hydraulic pressure is regulated by a solenoid-controlled actuator located remotely from any rotating components of the cam timing phaser arrangement.

8. The variable cam timing phaser arrangement according claim 7, wherein the solenoid-controlled actuator is a 3/2 way on/off solenoid valve having an inlet port in fluid communication with a source of increased fluid pressure, an outlet port in fluid communication with the selective deactivation device, and a vent port, wherein a primary state of the solenoid valve is a de-energized state preventing fluid communication from the source of increased fluid pressure to the selective deactivation device and allowing fluid communication from the selective deactivation device to the vent port, and wherein a secondary state of the solenoid valve is an energized state allowing fluid communication from the source of increased fluid pressure to the selective deactivation device and deploying the at least one deactivation element of the selective deactivation device.

9. The variable cam timing phaser arrangement according to claim 7, wherein the solenoid-controlled actuator comprises a solenoid-driven plunger arranged in a barrel, the barrel being arranged in fluid communication with the selective deactivation device, wherein a primary state of the solenoid-driven plunger is a retracted de-energized state and a secondary state of the solenoid-driven plunger is an extended energized state, the extended state increasing the pressure of the fluid at the selective deactivation device and deploying the at least one deactivation element of the selective deactivation device.

10. The variable cam timing phaser arrangement according to claim 6, wherein the selective deactivation device is deployed by a stationary mounted on/off solenoid.

11. A variable cam timing phaser arrangement, for an internal combustion engine comprising:

a rotor having at least one vane, the rotor arranged to be connected to a camshaft;

a stator co-axially surrounding the rotor, having at least one recess for receiving the at least one vane of the rotor and allowing rotational movement of the rotor with respect to the stator, the stator having an outer circumference arranged for accepting drive force, wherein the at least one vane divides the at least one recess into a first chamber and a second chamber, the first chamber and the second chamber being arranged to receive hydraulic fluid under pressure, wherein the introduction of hydraulic fluid into the first chamber causes the rotor to move in a first rotational direction relative to the stator and the introduction of hydraulic fluid into the second chamber causes the rotor to move in a second rotational direction relative to the stator, the second rotational direction being opposite the first rotational direction, wherein a source of increased fluid pressure is arranged in fluid communication with the first chamber and/or the second chamber via a refill channel; and a control assembly for regulating hydraulic fluid flow from the first chamber to the second chamber or vice-versa, wherein the control assembly comprises:

a first check valve;

a second check valve; and a selective deactivation device, wherein the first check valve and the second check valve are arranged in series in a fluid passage between the first chamber and the second chamber, wherein the first check valve is configured to prevent fluid flow in a first direction from the first chamber to the second chamber and to allow fluid flow in a second direction from the second chamber to the first chamber, and wherein the second check valve is configured to allow fluid flow in the first direction and to prevent fluid flow in the second direction, and wherein the selective deactivation device is deployable and is configured to selectively deactivate either the first check valve or the second check valve upon deployment, depending on the relative fluid pressure between the first chamber and the second chamber, whereby the deactivated first or second check valve allows fluid flow in both the first direction and second direction.

12. A method for controlling the timing of a camshaft in an internal combustion engine comprising a variable cam timing phaser arrangement, comprising:

a rotor having at least one vane, the rotor arranged to be connected to a camshaft;

a stator co-axially surrounding the rotor, having at least one recess for receiving the at least one vane of the rotor and allowing rotational movement of the rotor with respect to the stator, the stator having an outer circumference arranged for accepting drive force, wherein the at least one vane divides the at least one recess into a first chamber and a second chamber, the first chamber and the second chamber being arranged to receive hydraulic fluid under pressure, wherein the introduction of hydraulic fluid into the first chamber causes the rotor to move in a first rotational direction relative to the stator and the introduction of hydraulic fluid into the second chamber causes the rotor to move in a second rotational direction relative to the stator, the second rotational direction being opposite the first rotational direction; and a control assembly for regulating hydraulic fluid flow from the first chamber to the second chamber or vice-versa, wherein the control assembly comprises:

a first check valve;

a second check valve; and a selective deactivation device, wherein the first check valve and the second check valve are arranged in series in a fluid passage between the first chamber and the second chamber, wherein the first check valve is configured to prevent fluid flow in a first direction from the first chamber to the second chamber and to allow fluid flow in a second direction from the second chamber to the first chamber, and wherein the second check valve is configured to allow fluid flow in the first direction and to prevent fluid flow in the second direction, and wherein the selective deactivation device is deployable and is configured to selectively deactivate either the first check valve or the second check valve upon deployment, depending on the relative fluid pressure between the first chamber and the second chamber, whereby the deactivated first or second check valve allows fluid flow in both the first direction and second direction, the method comprising the steps:

i. providing the variable cam timing phaser arrangement having the selective deactivation device in a non-deployed state, thereby preventing fluid communication between the first chamber and the second chamber;

ii. deploying the selective deactivation device at a time to coincide with the first chamber having overpressure, thereby selectively deactivating the second check valve; or deploying the selective deactivation device at a time to coincide with the second chamber having overpressure, thereby selectively deactivating the first check valve;

iii. maintaining the deployment of the selective deactivation device thereby allowing fluid to periodically flow in a single direction between the first chamber and the second chamber due to camshaft torque, and preventing fluid flow in the opposite direction, thus rotating the rotor relative to the stator in a chosen direction; and iv. once the desired rotation of the rotor relative to the stator is obtained, disengaging the selective deactivation device, thereby preventing further fluid communication between the first chamber and the second chamber.

13. An internal combustion engine comprising a variable cam timing phaser arrangement comprising:

a rotor having at least one vane, the rotor arranged to be connected to a camshaft;

a stator co-axially surrounding the rotor, having at least one recess for receiving the at least one vane of the rotor and allowing rotational movement of the rotor with respect to the stator, the stator having an outer circumference arranged for accepting drive force, wherein the at least one vane divides the at least one recess into a first chamber and a second chamber, the first chamber and the second chamber being arranged to receive hydraulic fluid under pressure, wherein the introduction of hydraulic fluid into the first chamber causes the rotor to move in a first rotational direction relative to the stator and the introduction of hydraulic fluid into the second chamber causes the rotor to move in a second rotational direction relative to the stator, the second rotational direction being opposite the first rotational direction; and a control assembly for regulating hydraulic fluid flow from the first chamber to the second chamber or vice-versa, wherein the control assembly comprises:

a first check valve;

a second check valve; and a selective deactivation device, wherein the first check valve and the second check valve are arranged in series in a fluid passage between the first chamber and the second chamber, wherein the first check valve is configured to prevent fluid flow in a first direction from the first chamber to the second chamber and to allow fluid flow in a second direction from the second chamber to the first chamber, and wherein the second check valve is configured to allow fluid flow in the first direction and to prevent fluid flow in the second direction, wherein the selective deactivation device is deployable and is configured to selectively deactivate either the first check valve or the second check valve upon deployment, depending on the relative fluid pressure between the first chamber and the second chamber, whereby the deactivated first or second check valve allows fluid flow in both the first direction and second direction, and wherein the first check valve is deactivated upon deployment of the selective deactivation device whenever the second chamber has overpressure, and wherein the second check valve is deactivated upon deployment of the selective deactivation device whenever the first chamber has overpressure.

14. A vehicle comprising a variable cam timing phaser arrangement comprising:

a rotor having at least one vane, the rotor arranged to be connected to a camshaft;

a stator co-axially surrounding the rotor, having at least one recess for receiving the at least one vane of the rotor and allowing rotational movement of the rotor with respect to the stator, the stator having an outer circumference arranged for accepting drive force, wherein the at least one vane divides the at least one recess into a first chamber and a second chamber, the first chamber and the second chamber being arranged to receive hydraulic fluid under pressure, wherein the introduction of hydraulic fluid into the first chamber causes the rotor to move in a first rotational direction relative to the stator and the introduction of hydraulic fluid into the second chamber causes the rotor to move in a second rotational direction relative to the stator, the second rotational direction being opposite the first rotational direction; and a control assembly for regulating hydraulic fluid flow from the first chamber to the second chamber or vice-versa, wherein the control assembly comprises:

a first check valve;

a second check valve; and a selective deactivation device, wherein the first check valve and the second check valve are arranged in series in a fluid passage between the first chamber and the second chamber, wherein the first check valve is configured to prevent fluid flow in a first direction from the first chamber to the second chamber and to allow fluid flow in a second direction from the second chamber to the first chamber, and wherein the second check valve is configured to allow fluid flow in the first direction and to prevent fluid flow in the second direction, wherein the selective deactivation device is deployable and is configured to selectively deactivate either the first check valve or the second check valve upon deployment, depending on the relative fluid pressure between the first chamber and the second chamber, whereby the deactivated first or second check valve allows fluid flow in both the first direction and second direction, and wherein the first check valve is deactivated upon deployment of the selective deactivation device whenever the second chamber has overpressure, and wherein the second check valve is deactivated upon deployment of the selective deactivation device whenever the first chamber has overpressure.

* * * * *